US006526945B2

(12) United States Patent
Herzog et al.

(10) Patent No.: US 6,526,945 B2
(45) Date of Patent: Mar. 4, 2003

(54) CONTROL CIRCUIT FOR CONTROLLING AT LEAST ONE SOLENOID VALVE FOR FUEL METERING IN AN INTERNAL COMBUSTION ENGINE

(75) Inventors: Achim Herzog, Backnang (DE); Traugot Degler, Korntal-Muenchingen (DE); Andreas Koch, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 19 days.

(21) Appl. No.: 09/850,779

(22) Filed: May 8, 2001

(65) Prior Publication Data

US 2002/0005187 A1 Jan. 17, 2002

(30) Foreign Application Priority Data

May 11, 2000 (DE) ..... 100 22 956

(51) Int. Cl.[7] ..... F02M 51/00
(52) U.S. Cl. ..... 123/490; 361/152
(58) Field of Search ..... 123/490; 361/152, 361/155, 156

(56) References Cited

U.S. PATENT DOCUMENTS 5,515,830 A * 5/1996 Arakowa ..... 123/490
5,621,604 A * 4/1997 Carlson ..... 123/490
6,005,763 A * 12/1999 North ..... 123/490
6,044,823 A * 4/2000 Watanabe ..... 123/490
6,123,058 A * 9/2000 Endou ..... 123/490
6,360,725 B1 * 3/2002 Scherrbacher ..... 123/490
6,367,719 B1 * 4/2002 Wright ..... 123/490

FOREIGN PATENT DOCUMENTS

DE 195 39 071 9/1996

* cited by examiner

*Primary Examiner*—John Kwon
(74) *Attorney, Agent, or Firm*—Kenyon & Kenyon

(57) ABSTRACT

A control circuit for controlling solenoid valves for fuel metering in an internal combustion engine (banks I and II) includes a recharge circuit having a throttle coil in series with a diode and with a storage capacitor, as well as an FET power transistor connected in parallel with the series circuit of the diode and the storage capacitor. The solenoid valves of the individual banks are switched off during the rapid extinguishing with a voltage produced by the recharge circuit. To minimize the influence of the supply voltage, which comprises a wide range, the HS-FET is switched off during the rapid extinguishing phases.

9 Claims, 2 Drawing Sheets

CONTROL CIRCUIT FOR CONTROLLING AT LEAST ONE SOLENOID VALVE FOR FUEL METERING IN AN INTERNAL COMBUSTION ENGINE

FIELD OF THE INVENTION

The present invention relates to a control circuit for controlling at least one solenoid valve for fuel metering in an internal combustion engine.

BACKGROUND INFORMATION

Such a control circuit is for example discussed in German Published Patent Application No. 195 39 071. Using this control circuit, rapid solenoid valves are controlled, e.g., for common rail fuel injection or gasoline direct injection of internal combustion engines, via booster and battery supply voltage FET switches, and the energy is released during the transition from the pickup current to the retaining current being stored in a capacitor.

This circuit system may require a multiplicity of components and complex driver circuits that make it possible to use large currents to drive the valves to be controlled. Here, the resulting dependencies of the cutoff edges during the rapid disconnection of the solenoid valves from the battery voltage may be disadvantageous.

SUMMARY OF THE INVENTION

An object of an exemplary embodiment of the invention is to provide a control circuit for controlling at least one solenoid valve for fuel metering in an internal combustion engine, so that the cutoff edges during the rapid disconnection are largely independent of modifications of the battery voltage.

The control circuit according to an exemplary embodiment of the present invention includes a recharge circuit that is connected with the first and second terminal of the supply voltage to produce a pre-stabilized recharge voltage for the storage capacitor from the battery supply voltage, and is connected with the first switching apparatus, arrangement or structure, the recharge circuit supplying, via third switching apparatus, arrangement or structure, situated between the first terminal of the at least one solenoid valve and the recharge circuit, the solenoid valves with current from the energy stored in the storage capacitor in the booster phase, the recharge circuit also containing the storage capacitor as well as a fourth switching apparatus, arrangement or structure, that, controlled by the control apparatus, arrangement or structure, activates the recharge circuit in order to recharge the storage capacitor.

The dependence of the solenoid valve shutoff on modifications in the battery voltage is omitted to the greatest possible extent. The usable range of operation is thus expanded.

It is believed that the battery voltage can include a large range without influencing the shutoff (or operating, clearing) time of the solenoid valves. Here, the stabilized voltage can lie above or below the battery voltage.

DETAILED DESCRIPTION

Figure 1:
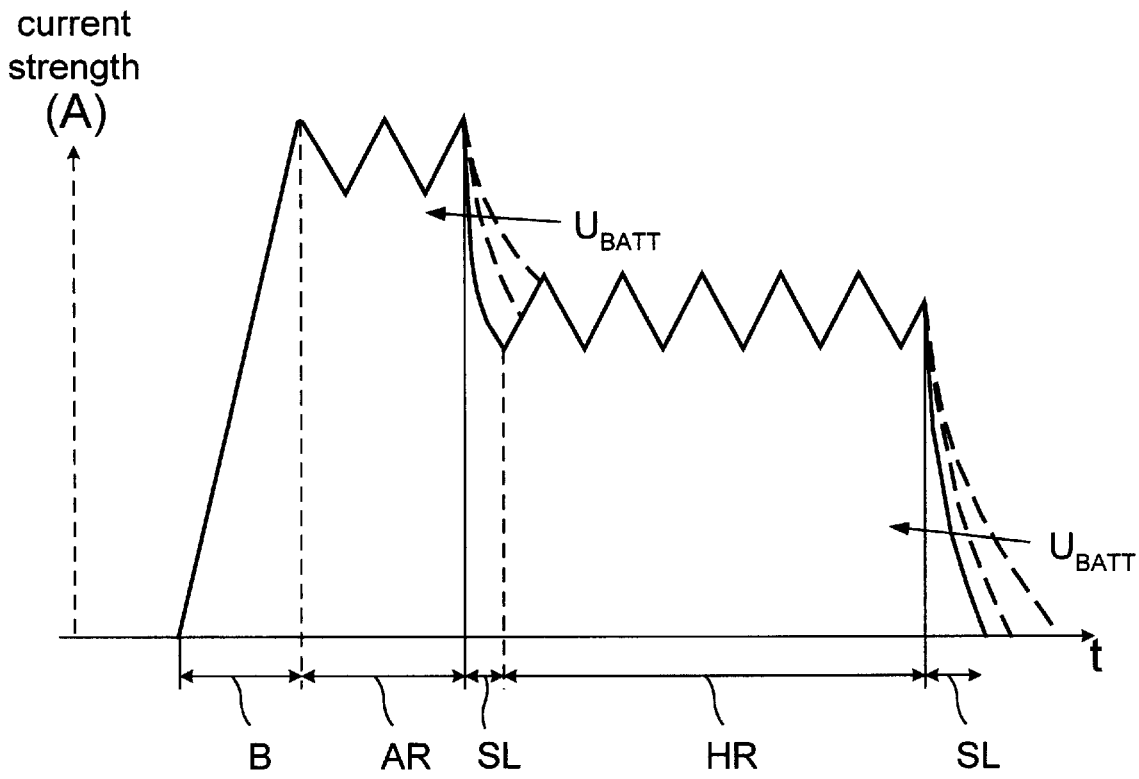
FIG. 1 shows a current curve over time in the controlling of a solenoid valve using the exemplary control circuit according to the present invention.

FIG. 1 shows the chronological curve of current strength I (in amperes) through a solenoid valve during a control process thereof. First, HS booster FET 140 or 141 (third switching apparatus, arrangement or structure) controls the current curve in the booster phase B from the energy stored in storage capacitor 145. During a pickup phase, the control circuit then executes, via first switching apparatus, arrangement or structure $U_{BATT}$ FET 115, a pickup circuit controlling AR; at a relatively high pickup current strength. There subsequently takes place a first rapid extinguishing SL to the retaining current strength, which is lower than the pickup current strength. During the retaining phase, the exemplary control circuit executes a retaining current controlling HR. There subsequently takes place a second rapid extinguishing SL to a zero (0) current strength.

Figure 2:
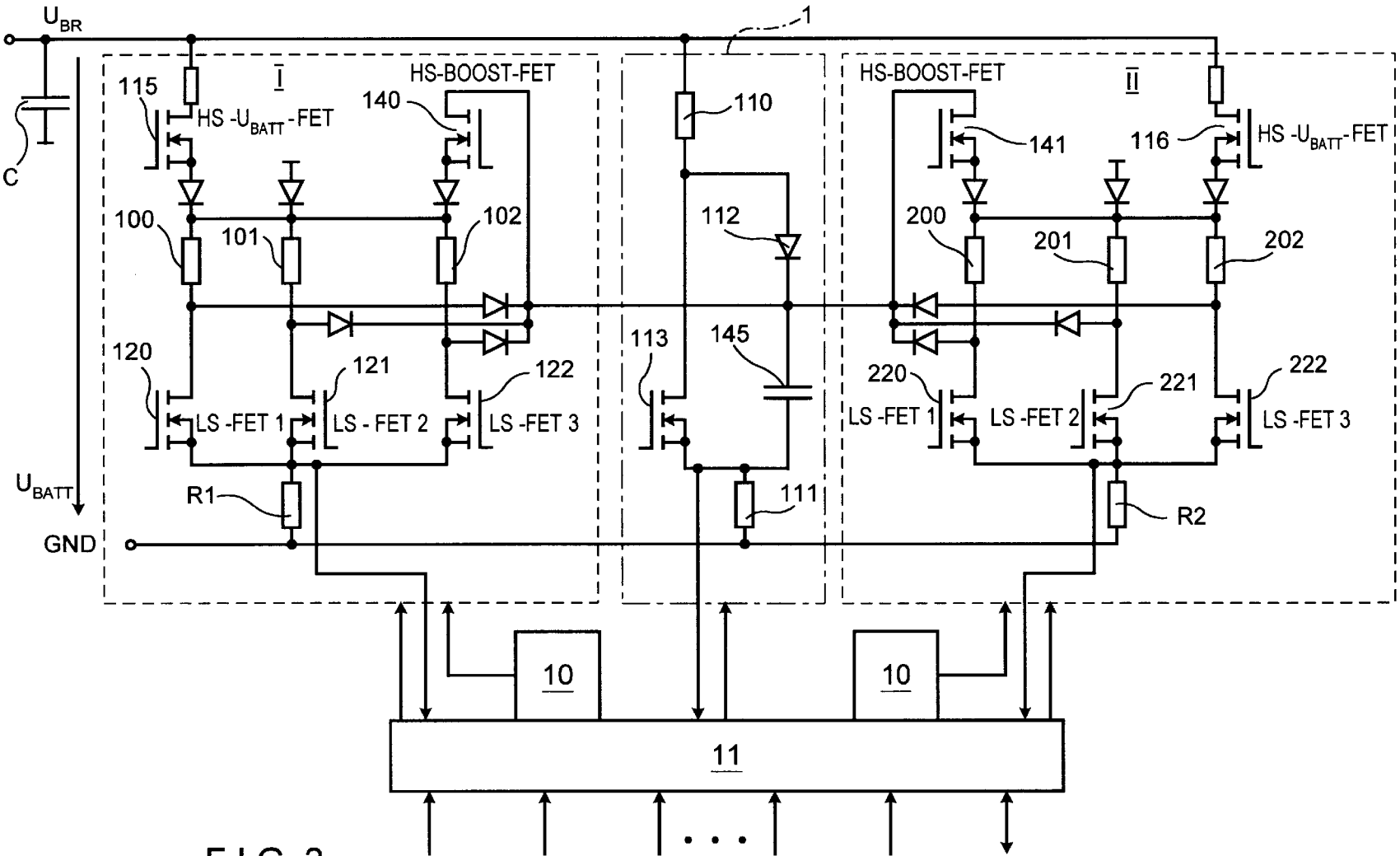
FIG. 2 shows a switching diagram of an exemplary embodiment of a control circuit according to the present invention.

FIG. 2 shows a block switching diagram of an exemplary control circuit as an example for two banks I and II. It can be seen that the circuit system of each of the two banks I and II is the same, and that recharge circuit 1 is common to both banks. The control terminals of high-side $U_{BATT}$ FETs 115, 116 of high-side booster FETs 140, 141 and of low-side FETs 120, 121, 122 and 220, 221, and 222 of the two banks are connected, through control lines (not shown), with driver circuits (control apparatus, arrangement or structure) 10 and 11.

Because the circuit arrangement of each of the banks is the same, only the arrangement of bank I is described. Bank I contains, for example, three solenoid valves 100, 101 and 102, whose high-side ends are connected with one another and that are supplied with current during the booster phase via high-side booster FET 140 and during the pickup phase and the retaining phase via high-side $U_{BATT}$ FET 115. The other ends of solenoid valves 100, 101, 102 are each connected via diodes with recharge circuit 1, and are connected, respectively via one of the low-side FETs 120, 121, 122 and a measurement resistor R1, with a ground terminal GND of battery supply voltage $U_{BATT}$. In addition, the high-side ends connected together of solenoid valves 100, 101 and 102 are connected with recharge circuit 1 via a diode and high-side booster FET 140.

Proposed recharge circuit 1 has, between a first battery supply voltage terminal $U_{BR}$ and second terminal GND of the battery supply voltage, a throttle coil 110, and has, connected in series therewith, a diode 112, a storage capacitor 145, and a measurement resistor 111, and, parallel to the series circuit of diode 112 with storage capacitor 145, a field-effect transistor 113.

The functioning of the control circuit shown in FIG. 2 is as follows. Solenoid valves to be controlled 100, 101, 102 of bank I, as well as 200, 201, 202 of bank II, are respectively selected via corresponding low-side FET 120, 121, 122 or 220, 221, 222. During booster phase B, introduced at the beginning, high-side booster FET 140 of bank I, or 141 of bank II, controls the current curve. In the pickup and retaining phase, the current curve is controlled by high-side $U_{BATT}$ FET 115 or 116.

Rapid extinguishing phases SL are produced through simultaneous switching off of low-side field-effect transistors 120, 121, 122 or 220, 221, 222 and high-side field-effect transistors 115 or 116.

The battery-voltage-dependent curves of the transitions into rapid extinguishing phases SL shown in broken lines in FIG. 1, which have an influence on quantity after the retaining phase during the main injection and, if necessary, after the pickup phase during pre-injection, are avoided.

During rapid extinguishing phases SL, when high-side $U_{BATT}$ FET 115 or 116 is switched on, additional energy is conducted back into the storage capacitor via the rapid extinguishing diodes. In order to improve the energy balance, after the pickup phase high-side field-effect transistor 115 or 116 may remain switched on.

Proposed recharge circuit 1 conducts the energy losses back to storage capacitor 145.

Recharge circuit 1 either clocks continuously and/or is controlled correspondingly in order to achieve a desired voltage. Resistor 111, connected in series between storage capacitor 145 and second terminal GND of supply voltage $U_{BATT}$, is used to measure the voltage at storage capacitor 145. The "hot" end of measurement resistor 111 is connected with driver circuit 11 or with the control arrangement.

Driver circuit 11 is connected with a higher-order control unit (not shown) via a line system.

With the foregoing, it is believed that the following advantages may result: the solenoid valves may be cut off (or terminated, reset) independent of the battery voltage; the battery voltage may include a large range without influencing the shutoff time of the solenoid valve; the battery voltage compensation of the control duration, in other control circuits, may be simplified significantly; and battery voltage dependencies for the solenoid valve controlling may be omitted to the largest possible extent to expand the useful operating range.

What is claimed is:

1. A circuit arrangement for controlling at least one solenoid valve for fuel metering in an internal combustion engine, the circuit arrangement comprising:

a first switching arrangement situated between a first supply voltage terminal of a battery supply voltage and a first terminal of the at least one solenoid valve;

a second switching arrangement situated between a second terminal of an allocated one of the at least one solenoid valve and a second supply voltage terminal of the battery supply voltage;

a storage capacitor for connection with the second terminal;

a recharge circuit; and a third switching arrangement situated between the first terminal of the at least one solenoid valve and the recharge circuit;

wherein:

the second switching arrangement includes a control arrangement for controlling the second switching arrangement for storing energy in the storage capacitor as stored energy, the energy being released in one of (i) a rapid transition from a pickup current value to a retaining current value and (ii) another rapid transition from the retaining current value to a zero current strength, the stored energy being available for supplying the at least one solenoid valve in a booster phase;

the first switching arrangement is switched off during the rapid transitions to minimize a battery voltage dependence; and the recharge circuit is connected with the first supply voltage terminal and the second supply voltage terminal, and includes the storage capacitor and a fourth switching arrangement that is controlled by the control arrangement and that activates the recharge circuit for recharging the storage capacitor, the recharge circuit being used for a voltage supply of the at least one solenoid valve via the third switching arrangement during the booster phase using the stored energy from the storage capacitor, and for producing a pre-stabilized recharge voltage for the storage capacitor from the battery supply voltage.

2. The control circuit of claim 1, wherein the control arrangement is arranged for continuously clocking the fourth switching arrangement.

3. The control circuit of claim 1, wherein:

the recharge circuit includes a measurement arrangement for supplying a voltage value, measured at the storage capacitor, to the control arrangement; and the control arrangement controls the fourth switching arrangement for recharging the storage capacitor only if an acquired voltage at the storage capacitor lies below a determined target value.

4. The control circuit of claim 3, wherein the measurement arrangement includes a resistor connected in series between the storage capacitor and the second supply voltage terminal.

5. The control circuit of claim 1, wherein the recharge circuit includes a throttle coil connected in series to the storage capacitor and a diode connected in series between the throttle coil and the storage capacitor, a connecting point of the diode and the storage capacitor being connected with the second terminal of the at least one solenoid valve.

6. The control circuit of claim 5, wherein the fourth switching arrangement is connected in parallel to a series circuit of the diode and the storage capacitor.

7. The control circuit of claim 1, wherein the first switching arrangement includes at least one FET power switching transistor.

8. The control circuit of claim 1, wherein:

the at least one solenoid valve, the first switching arrangement, the second switching arrangement and the third switching arrangement are grouped in a plurality of banks, each of the plurality of banks having a plurality of solenoid valves;

the first switching arrangement includes a high-side field-effect transistor;

the second switching arrangement includes a plurality of low-side field-effect transistors respectively allocated to the plurality of solenoid valves; and the third switching arrangement includes a high-side field-effect transistor.

9. The control circuit of claim 8, wherein:

an end facing away from the plurality of solenoid valves of the plurality of low-side field-effect transistors of each of the plurality of banks are individually connected together and are connected in common with an end of a respective measurement resistor, whose other end is connected with the second supply voltage terminal; and a voltage value is obtainable at an end, connected respectively with the plurality of low-side field-effect transistors, of the respective measurement resistor, for supply to the control arrangement.

* * * * *